US006615882B1

(12) United States Patent
Hsieh

(10) Patent No.: US 6,615,882 B1
(45) Date of Patent: Sep. 9, 2003

(54) FILLING DEVICE OF A DUAL LAYERED FILLING AND PACKING DEVICE

(76) Inventor: Shui Yung Hsieh, P.O. Box 82-144, Taipei (TW)

( * ) Notice: Subject to any disclaimer, the term of this patent is extended or adjusted under 35 U.S.C. 154(b) by 0 days.

(21) Appl. No.: 10/093,413

(22) Filed: Mar. 11, 2002

(51) Int. Cl.[7] ..... B65B 1/04

(52) U.S. Cl. ..... 141/114; 141/313; 53/51; 53/550; 53/553; 53/371.4

(58) Field of Search ..... 141/114, 313, 141/67, 10, 314, 315; 53/51, 64, 550, 553, 371.4, 374.4

(56) References Cited

U.S. PATENT DOCUMENTS 5,893,256 A * 4/1999 Ghirlandi ..... 53/134.2
6,098,380 A * 8/2000 Goodwin et al. ..... 53/451
6,122,894 A * 9/2000 Romagnoli ..... 53/51

* cited by examiner

*Primary Examiner*—Steven O. Douglas
(74) *Attorney, Agent, or Firm*—Leong C. Lei

(57) ABSTRACT

A filling device of a dual-layered filling and packing device having a cotton paper device within the packing device which guides cotton paper via a guide rack to fold the paper and to fill a paper bag with fixed amount of tea leaves, by means of a roller, the paper bag with tea leaves being sealed at the edges thereof, and by means of a gripping structure, the tea bag being held to a funnel tube of the folding structure, a plurality of rollers delivered packing foil from an insertion section through space between a folding slot and the funnel tube, characterized in that the gripping structure composes a magnetic cylinder interconnected to a Y-shaped pneumatic cylinder and the gripping section is extended with two corresponding folding board and the folding structure comprises a folding slot covered a gap outside the funnel tube, the cross-section of the funnel tube has a flat body and the folding slot is a U-shaped plate body having a top end folded outward to form the insertion section.

3 Claims, 16 Drawing Sheets

FILLING DEVICE OF A DUAL LAYERED FILLING AND PACKING DEVICE

BACKGROUND OF THE INVENTION (a) Field of the Invention

The present invention relates to a filling device of a dual layered filling and packing device, and in particular to a packing device which fills inner tea bag with or without tag into dual layered tea bag having an outer foil bag.

(b) Description of the Prior Art

Most packages for food and medicines are single layered package, facilitating to carry along when it is a necessary. In view of the above, coffee bags, or tea bags are commonly available in the market. Particularly, tea leaves packages have to be properly done so as to avoid the tea leaves within the package from contamination. As a result, a non-porous foil bag is used to pack the inner tea bag, and the tea bag is then sealed. Conventionally, the filling and packing device is only restricted to packaging of tea leaves for a specific amount, and manual operation is needed so as to put the inner cotton paper bag into the foil bag. As a result, the efficiency of such operation is low and it is unhygienic. It is an object of the present invention to provide a filling device of a dual layered filling and packing device which mitigates the above-mentioned drawbacks.

SUMMARY OF THE INVENTION

Accordingly, it is an object of the present invention to provide a filling device of a dual layered filling and packing device, wherein a reciprocating grip structure is corresponding to a folding structure to deliver reciprocating so that the inner layer packing bag can be directly filled into the foil bag for sealing, thus the production efficiency is improved and the quality is maintained.

Another object of the present invention is to provide a filling device of a dual layered filling and packing device, wherein a guiding tag is directly deliver to the folding structure and the tea bag is delivered to the folding structure, the tag is dropped into the funnel tube of the folding structure so as to proceed with automatic packaging.

Yet a further object of the present invention is to provide a filling device of a dual layered filling and packing device, wherein a clipping arm is provided below the tag guiding rack, thereby the clipping arm holds the sealed tag and the cotton thread, and the tag is pulled a distance, and a cut is used to cut the sealed tag.

Other objects and advantages of the present invention will become more apparent from the following description taken in conjunction with the accompanying drawing.

DETAILED DESCRIPTION OF THE PRESENT INVENTION

Figure 1:
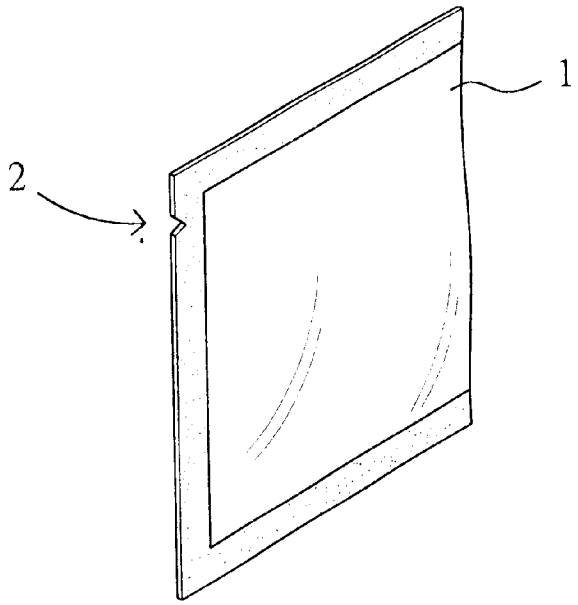
FIG. 1 is a perspective view of the dual-layered tea bag in accordance with the present invention.
Figure 2:
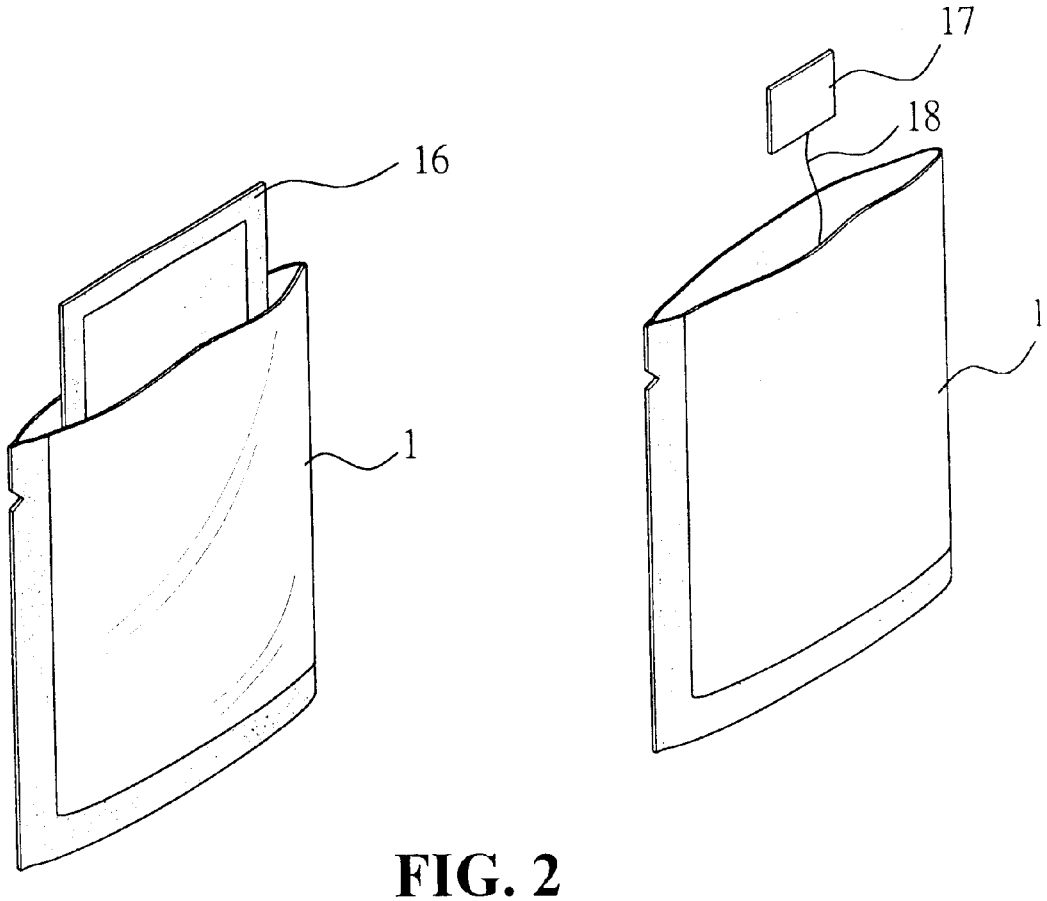
FIG. 2 is the external perspective view of the dual-layered tea bag when it undergoes a tearing in accordance with the present invention.
Figure 3:
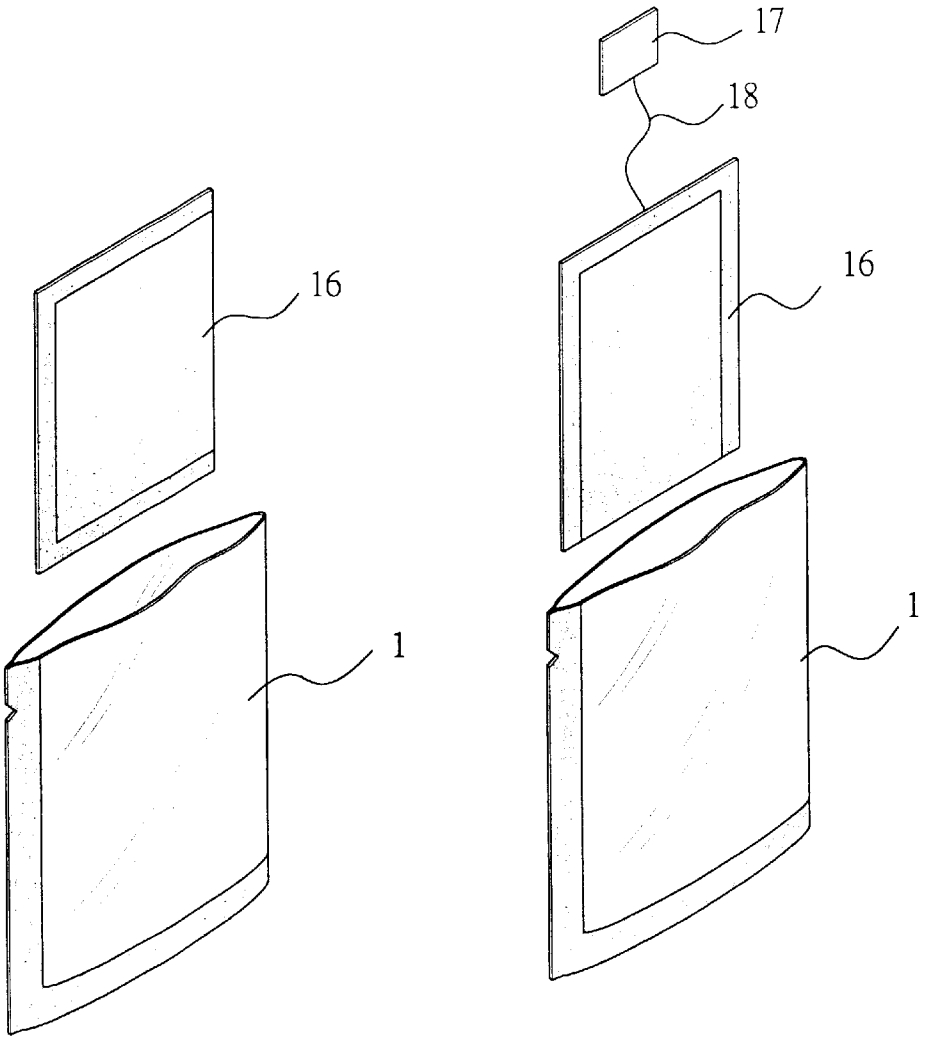
FIG. 3 is the external perspective view of the dual-layered tea bag when it is taken out for use in accordance with the present invention.

Referring to FIGS. 1 to 3, there is shown a device forming dual layered tea bag 1 having an inner paper tea bag 16 enclosed by an outer foil 70. One side of the dual layered tea bag 1 is provided with a notch 2, facilitating the tearing of the foil 70 to take up the inner paper tea bag 16.

Figure 4:
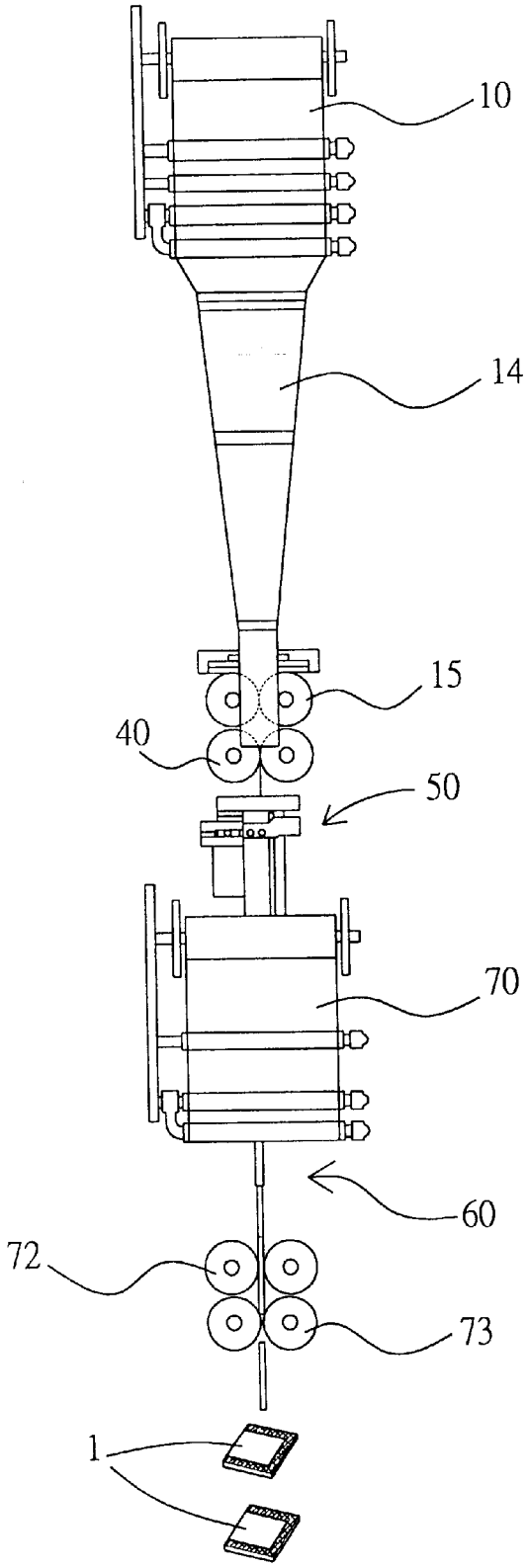
FIG. 4 is a plan view of the present invention.
Figure 5:
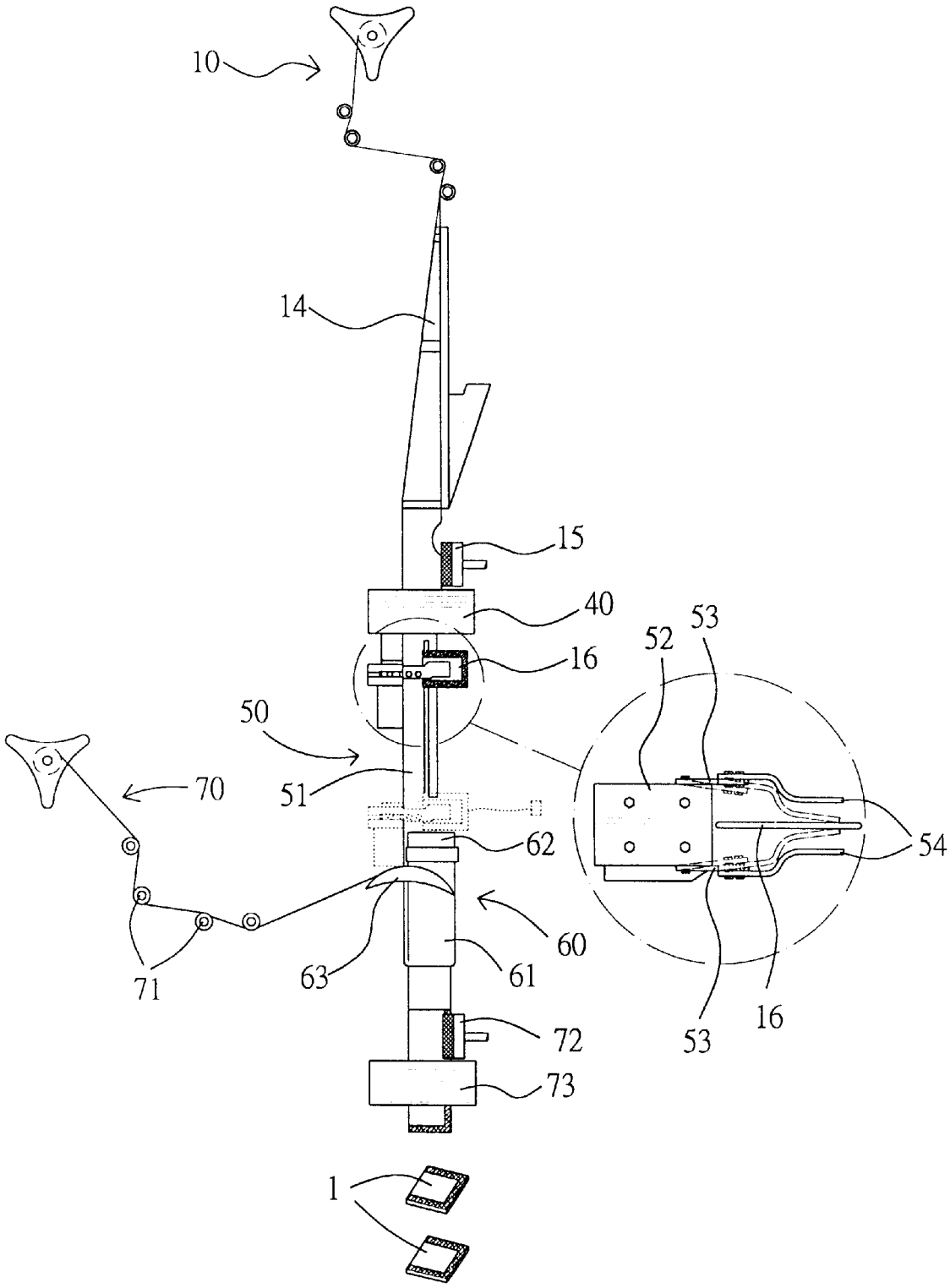
FIG. 5 is a side view of the present invention.
Figure 6:
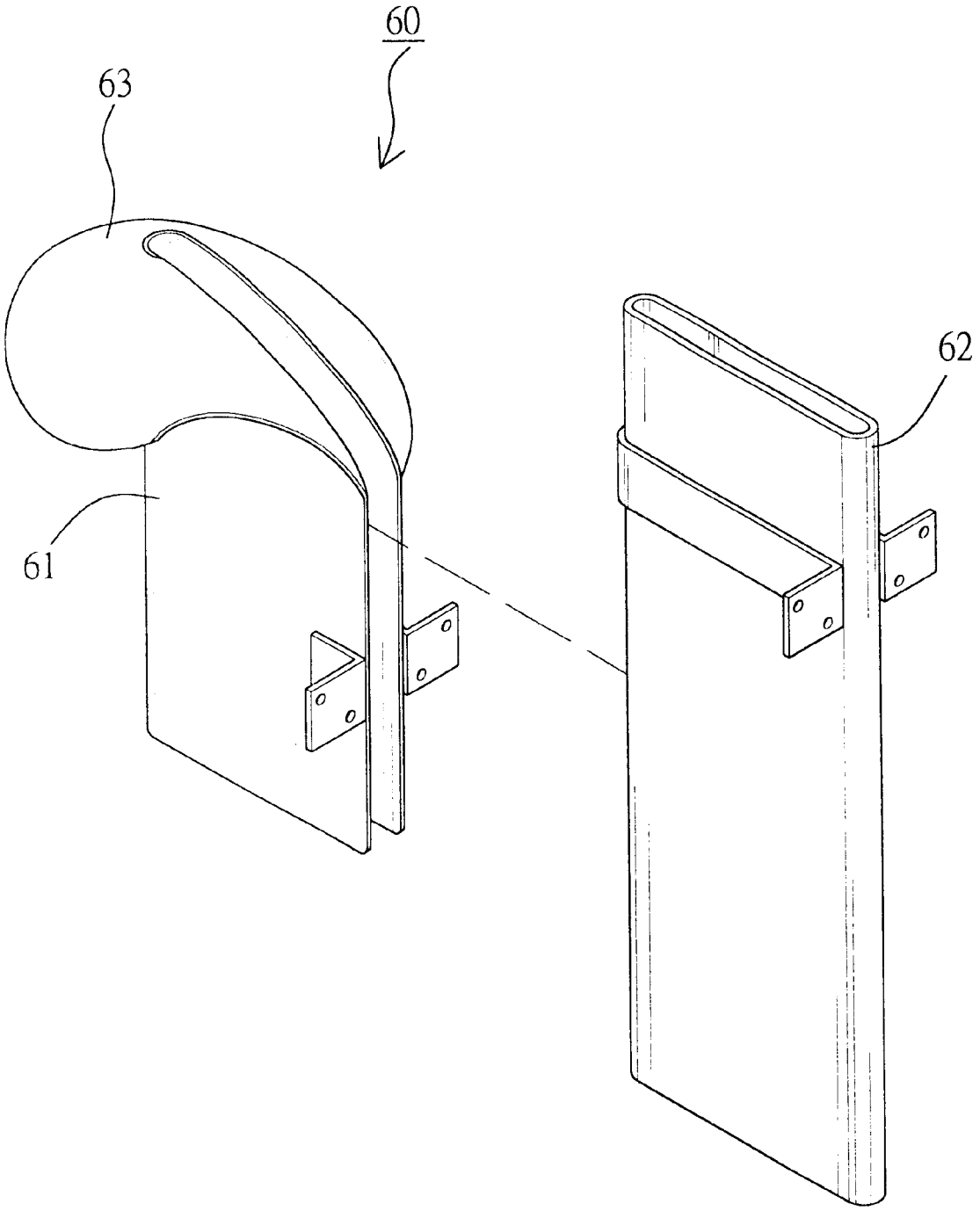
FIG. 6 is a perspective exploded view of the folding structure in accordance with the present invention.
Figure 7:
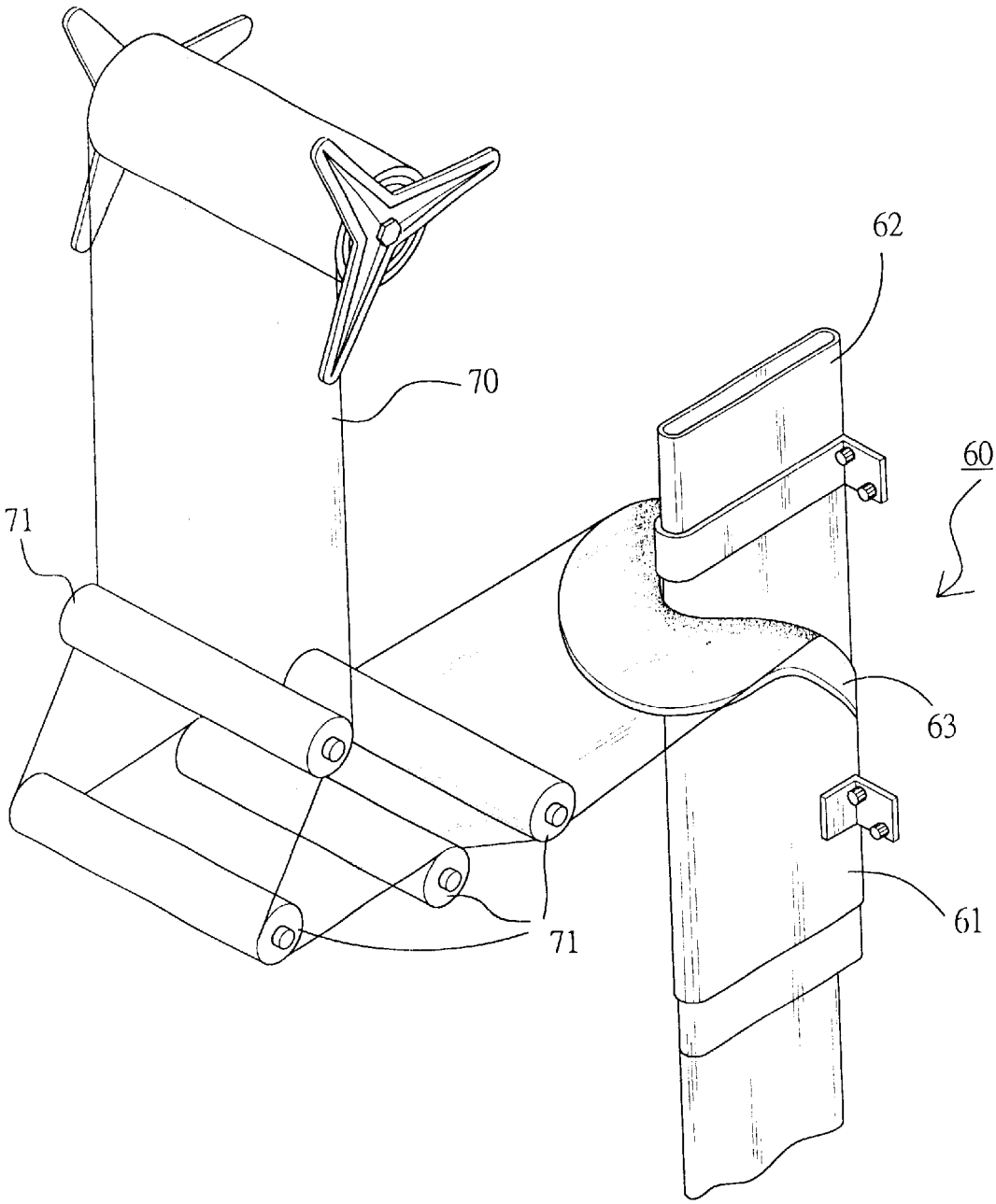
FIG. 7 is a schematic view showing delivery of the folding structure in accordance with the present invention.

As shown in FIGS. 4 and 5, a cotton paper device 10 within a packing device guides the cotton paper via a guide rack 14 to fold the paper and at the same time fill the bag package with fixed amount material, for instance, tea leaves. By means of roller 15 to seal the edges and by means of a cutting roller 40 to cut both ends so that a sealed tea bag 16 is formed. A gripping structure is used to hold the tea bag 16 to the funnel tube 62 of the folding structure 60 for filling. A plurality of rollers 71 deliver the outer packing foil 70 from an insertion section 63 through space between a folding slot 61 and the funnel tube 62 and is then extended out (as shown in FIGS. 6 and 7). The lateral side of the folding structure 60 is provided with a roller 72 to seal the edge and is provided with a cutting roller 73 to cut the dual-layered tea bag 1 for delivery.

In accordance with the present invention, the filling device is characterized in that (a) the gripping structure 50 comprises a magnetic cylinder 51 interconnected to a Y-shaped pneumatic cylinder 52 and the gripping section 53 is extended with two corresponding folding board 54;

(b) the folding structure 60 comprises a folding slot 61 covered a gap outside the funnel tube 62, the cross-section of the funnel tube 62 has a flat body and the folding slot 61 is a U-shaped plate body having a top end folded outward to form the insertion section 63 (as shown in FIGS. 6 and 7).

The reciprocation of the magnetic pneumatic cylinder 51 drives the Y-shaped pneumatic cylinder 52 to cause the gripping structure 50 to perform up and down movement. Thus, after each inner-layered tea bag 16 is sealed, the gripping structure 50 will be driven and the gripping section 53 causes the folding board 54 to grip the tea bag 70 to deliver to the folding structure 60. At this instance, the outer-layered foil 70 follows the folding slot 61 to produce a folding effect.

As the foil 70 is positioned within the folding slot 61 and covered outside the funnel 62, and the bottom end of the foil 70 is extended downward of the folding structure 60, the foil 70 is then sealed by the roller 72 and the cutting roller 73 to cut such that the foil 70 is cut at the top end of a former bag and at the bottom end of a subsequent bag to form a dual-layered tea bag 1.

Figure 8:
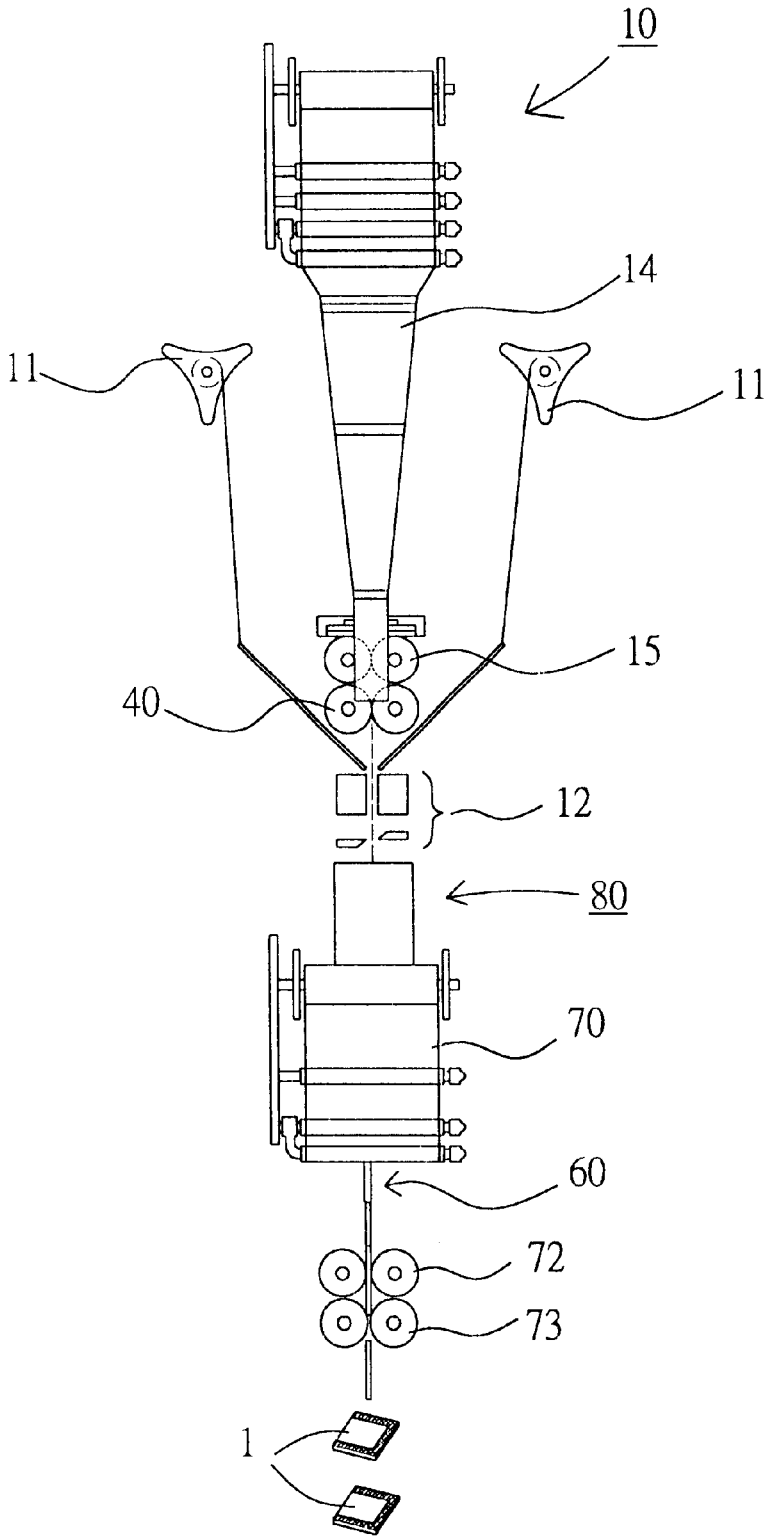
FIG. 8 is a plan view of the inner-layered tea bag having a tag in accordance with the present invention.
Figure 9:
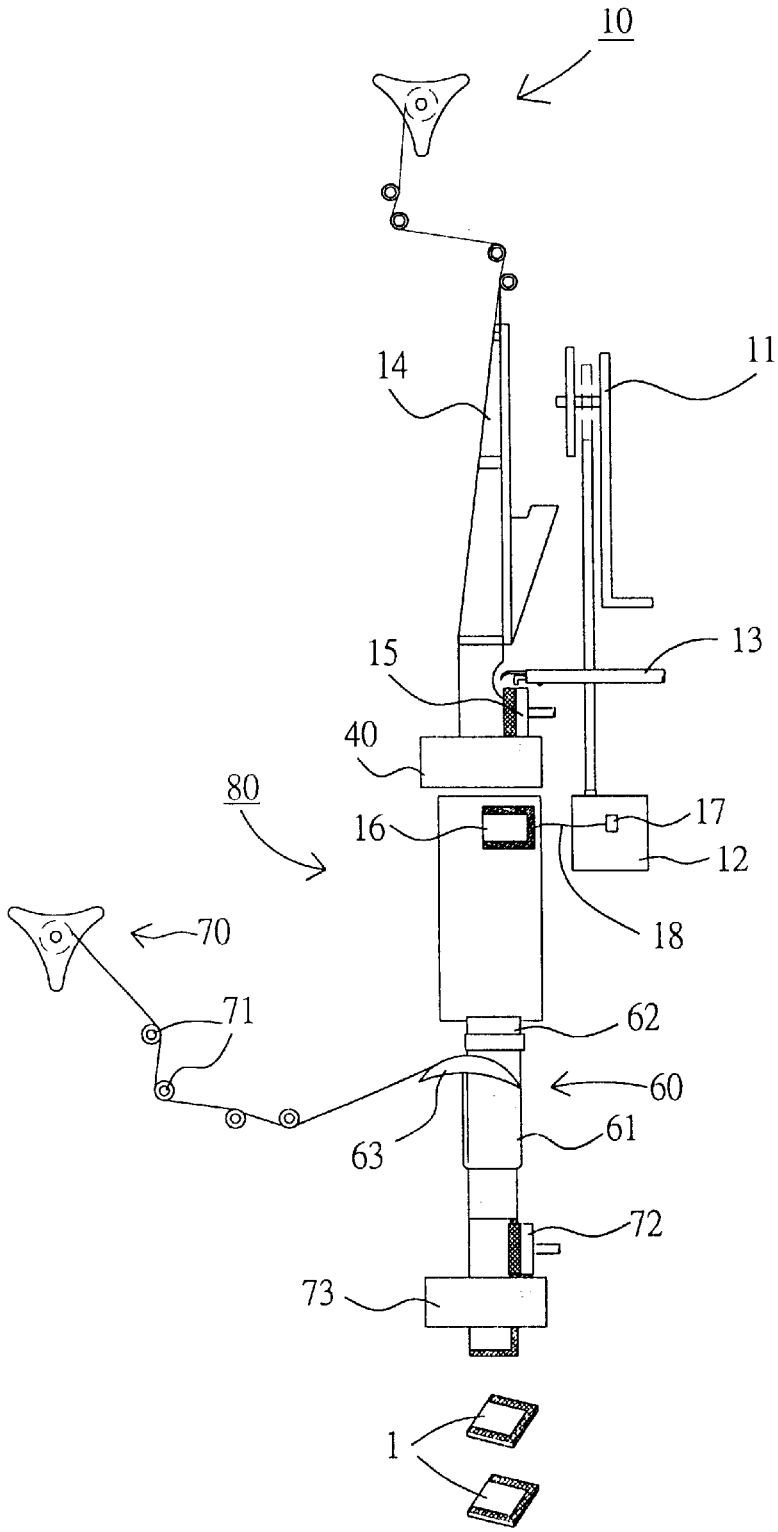
FIG. 9 is a side view of the inner-layered tea bag having a tag in accordance with the present invention.

Referring again to FIGS. 1 to 3, when a tag 17 is connected to the inner layered tea bag 16 by a cotton thread 18, as shown in FIGS. 8 and 9, a threading device 13 delivers one end of the cotton thread 18 in between the rollers 15 for sealing and a pair of tagging device 11 cause the tagging paper to be inserted into the cutting device 12. The other end of the cotton thread 18 is mounted onto the tag 17 and the top end of the tea bag 16 is connected by a cotton thread.

The rotating gripping structure 80 holds the inner-layered tea bag 16 and rotates 90 degree to the funnel tube 62 for filing. The outer-layered foil 70 is delivered to the space between the folding slot 61 and the funnel tube 62 from the insertion section by means of a plurality of rollers 71, and the side of the folding structure 60 is provided with the roller 72 for sealing the edges, and the cutting roller 73 is positioned at the lower section to deliver the cut tea bag.

Figure 10:
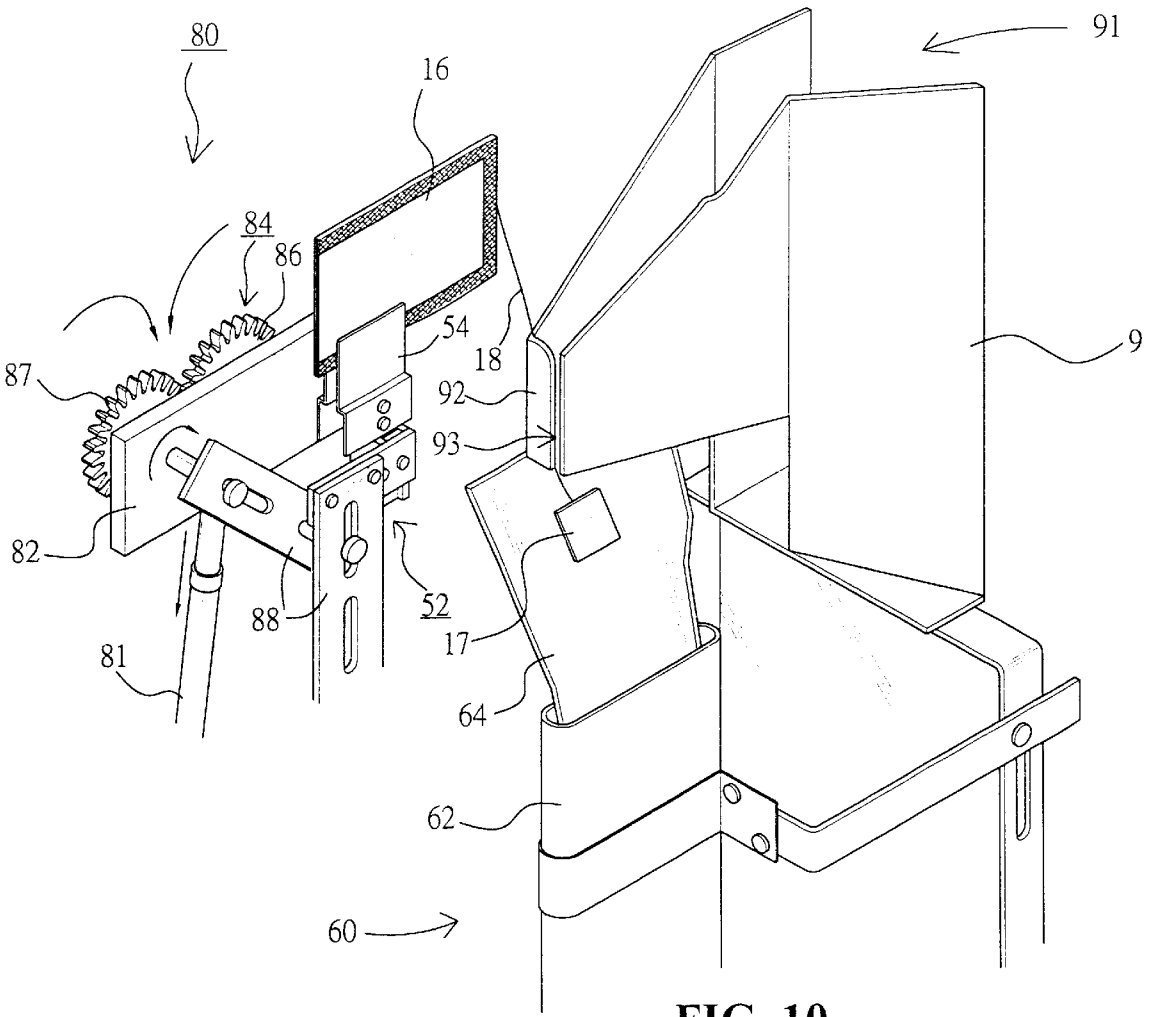
FIG. 10 is a perspective schematic view of the rotating gripping structure in accordance with the present invention.

As shown in FIG. 10, the gripping structure 80 has a pneumatic cylinder 81 driving a swinging arm 82 to rotate. The center of rotating of the arm 82 is located on a gear 83, and on the swinging arm 82, stepped gear 84, gripping gear 87 are pivotally mounted such that the small gear 85 of the stepped gear 84 is in engagement with the gear 83. The big gear 86 is in engagement with the gripping gear 87, and the stepped gear 84 is pivotally connected with the pneumatic cylinder 81. The gripping gear 87 is extended out with two connection plates 88 from the swinging arm 82 for the mounting of Y-shaped pneumatic cylinder 52. The gripping section of the Y-shaped pneumatic cylinder 52 extended outward by means of the folding boards 54.

Figure 11:
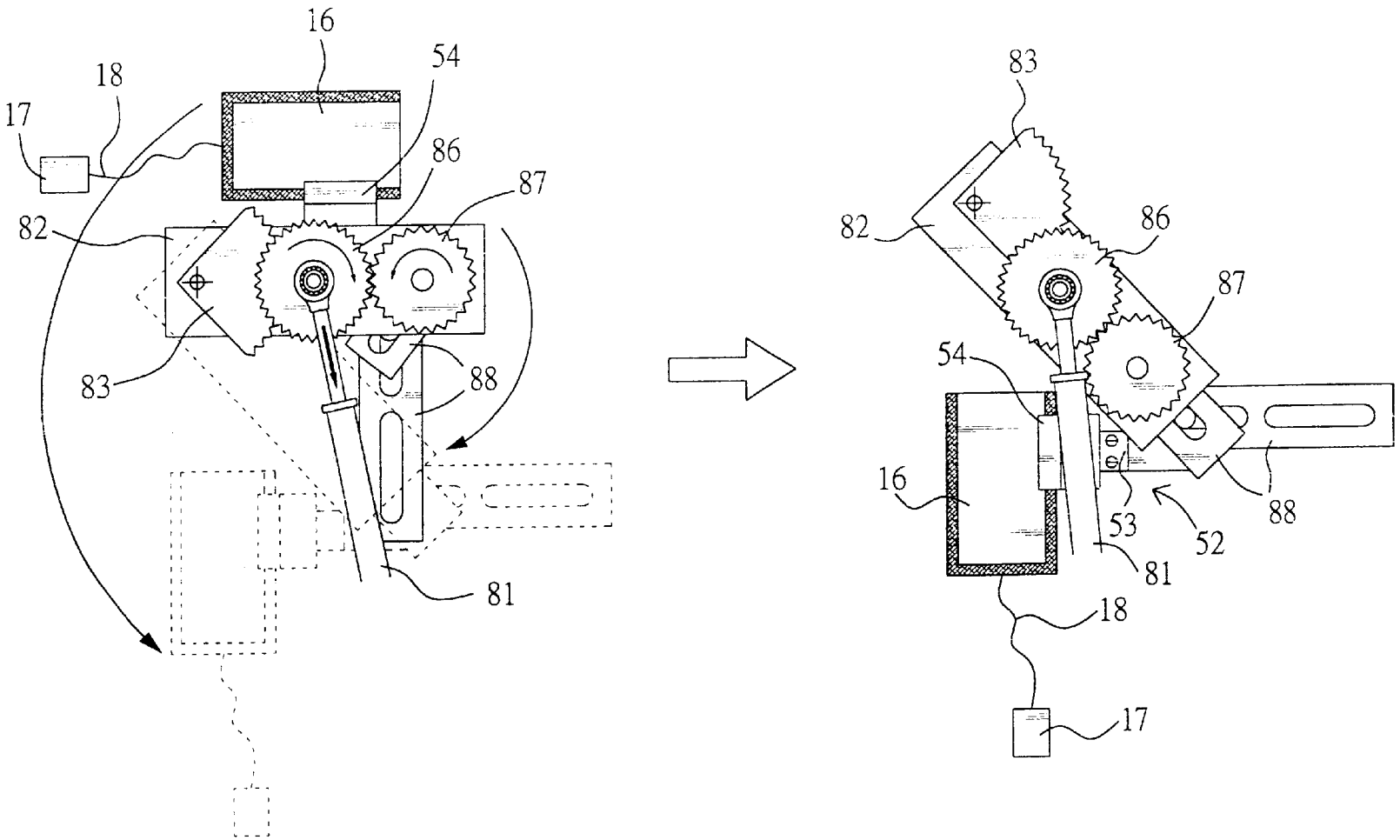
FIG. 11 is schematically shown the action of the rotating gripping structure in accordance with the present invention.
Figure 12:
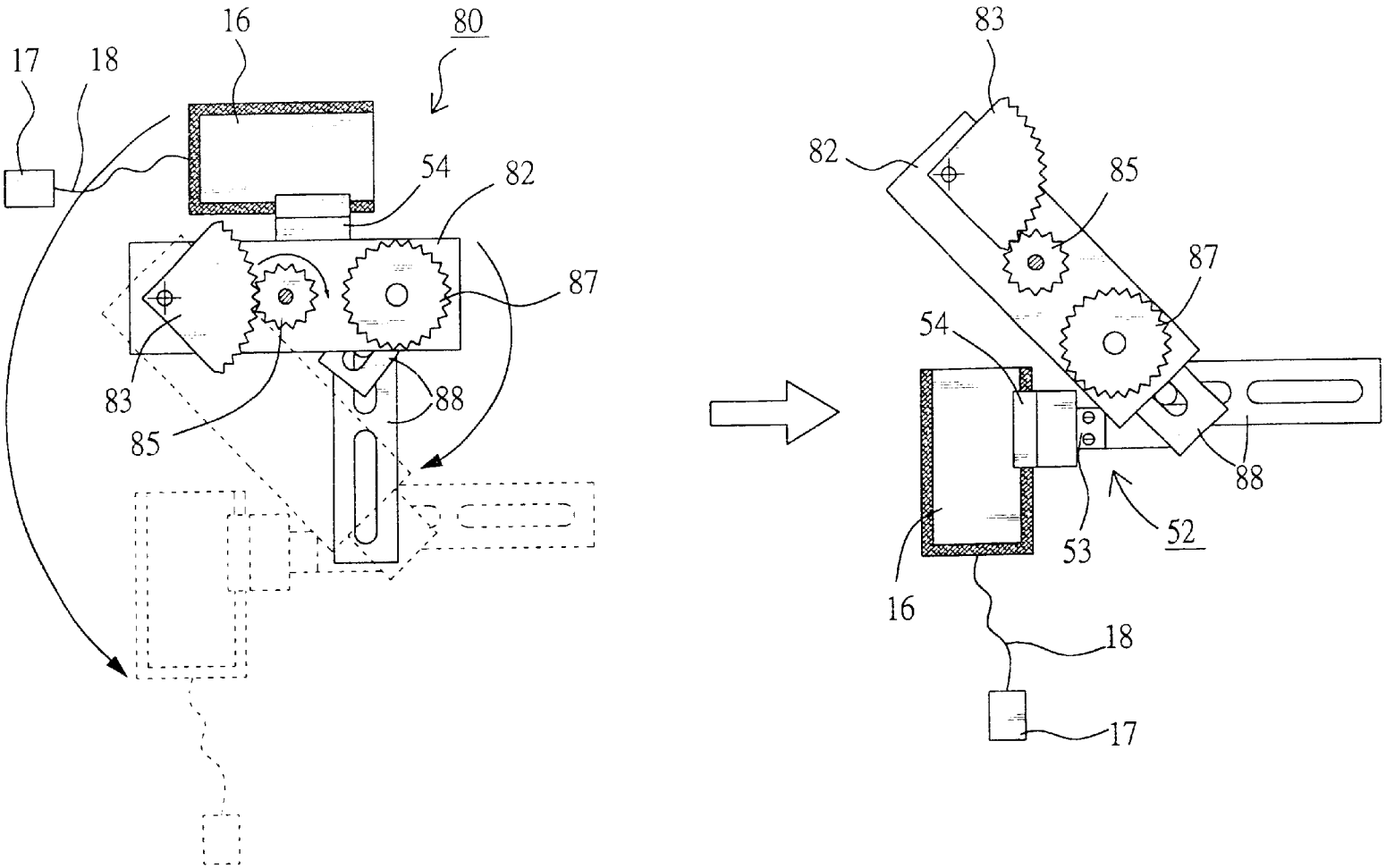
FIG. 12 is another schematic view showing the action of the rotating gripping structure in accordance with the present invention.

As shown in FIGS. 10 and 11, when the rotating gripping structure 80 is extended out from the pneumatic cylinder 81, the entire swinging arm 82 will rotate upward, and the stepped gear 84 and the gripping gear 87 rotate in opposite direction. That is, the connection plate 88 joined to the gripping gear 87 and the Y-shaped pneumatic cylinder 52 correspondingly produce a swinging moment, and the folding board 54, by means of the driving gripping section 53, holds the produced dual-layered tea bag 1. When the magnetic pneumatic cylinder 51 is retracted, the swinging arm 82 is driven to rotate downward such that the height of the entire rotating gripping structure 80 is nearer to the folding structure 60. The tea bag 16 gripped by the gripping section 53 is placed on the top section of the funnel tube 62.

Next, the tag 17 of the tea bag 16, in the course of sealing, is extended to the cutting device 12 by means of cotton thread 18. When opening the notch 91 at the rear end of the guiding slot 9 is corresponding to the cutting device 12, the tag 17 will be placed from the opening 91 to the guiding slot 9, and is in contact and stopped at the upper section of the sloping plate 64 at the top end of the funnel tube 62. At this instance, when the gripping structure 80 delivers the tea bag 16 downward to the tag 17 is first dropped within the funnel tube 62 from the notch 93, and when the folding plate 54 of the gripping section 53 places the tea bag 16 to restrict the top of the tag 17, the tag 17 and the tea bag 16 will drop to the outer-layered packing foil 70. As a result of the roller 71 for sealing, a dual-layered tea bag 1 is obtained.

The two connection plate 88 of the gripping structure 80 is fastened by screwing, the position of the Y-shaped pneumatic cylinder 52 can be adjusted by means of the distance and angle of the two connection plates 88. This allows the delivery of tea bags of various sizes.

Figure 13:
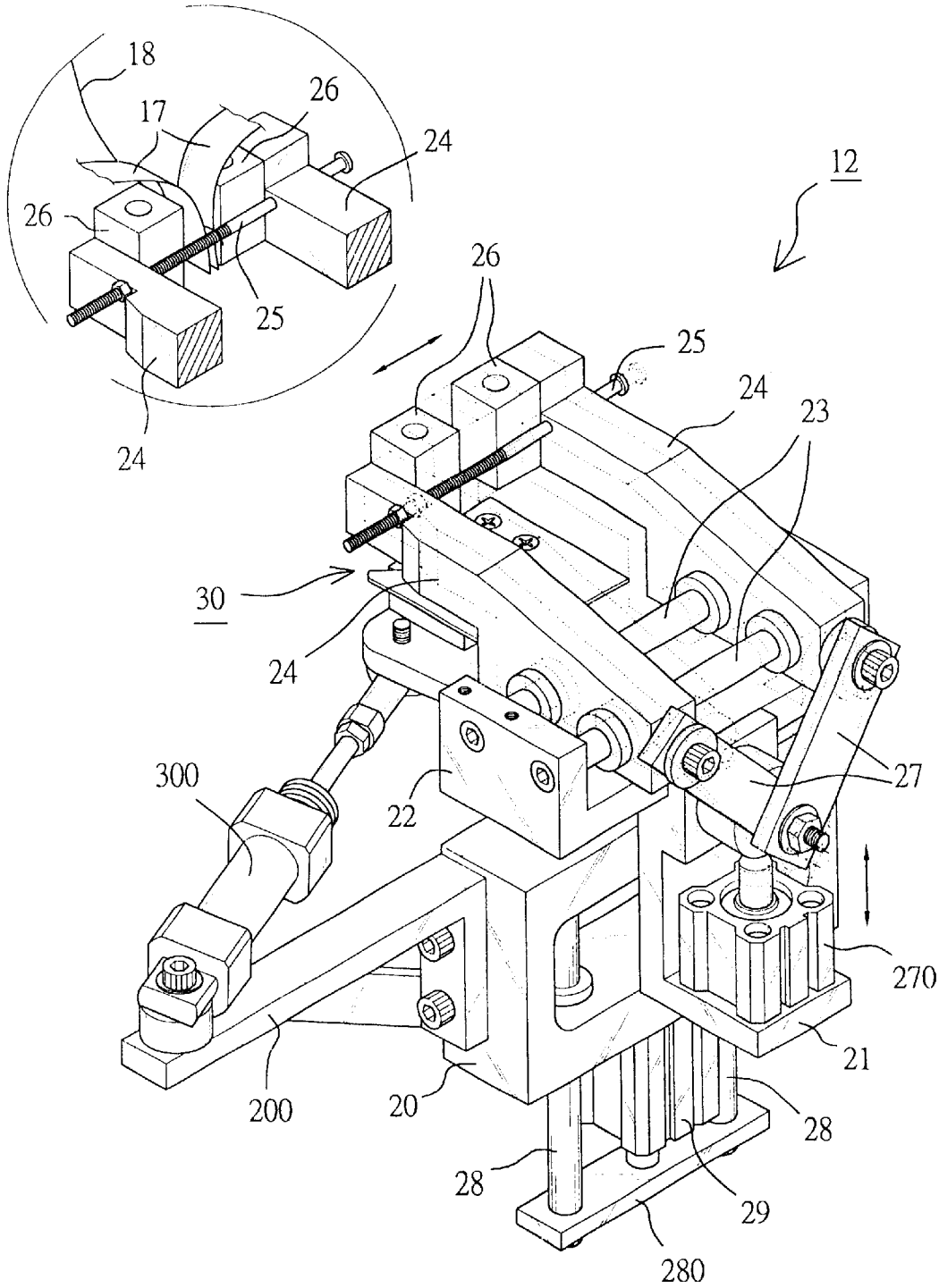
FIG. 13 is a perspective view of the cutting device of the present invention.
Figure 14:
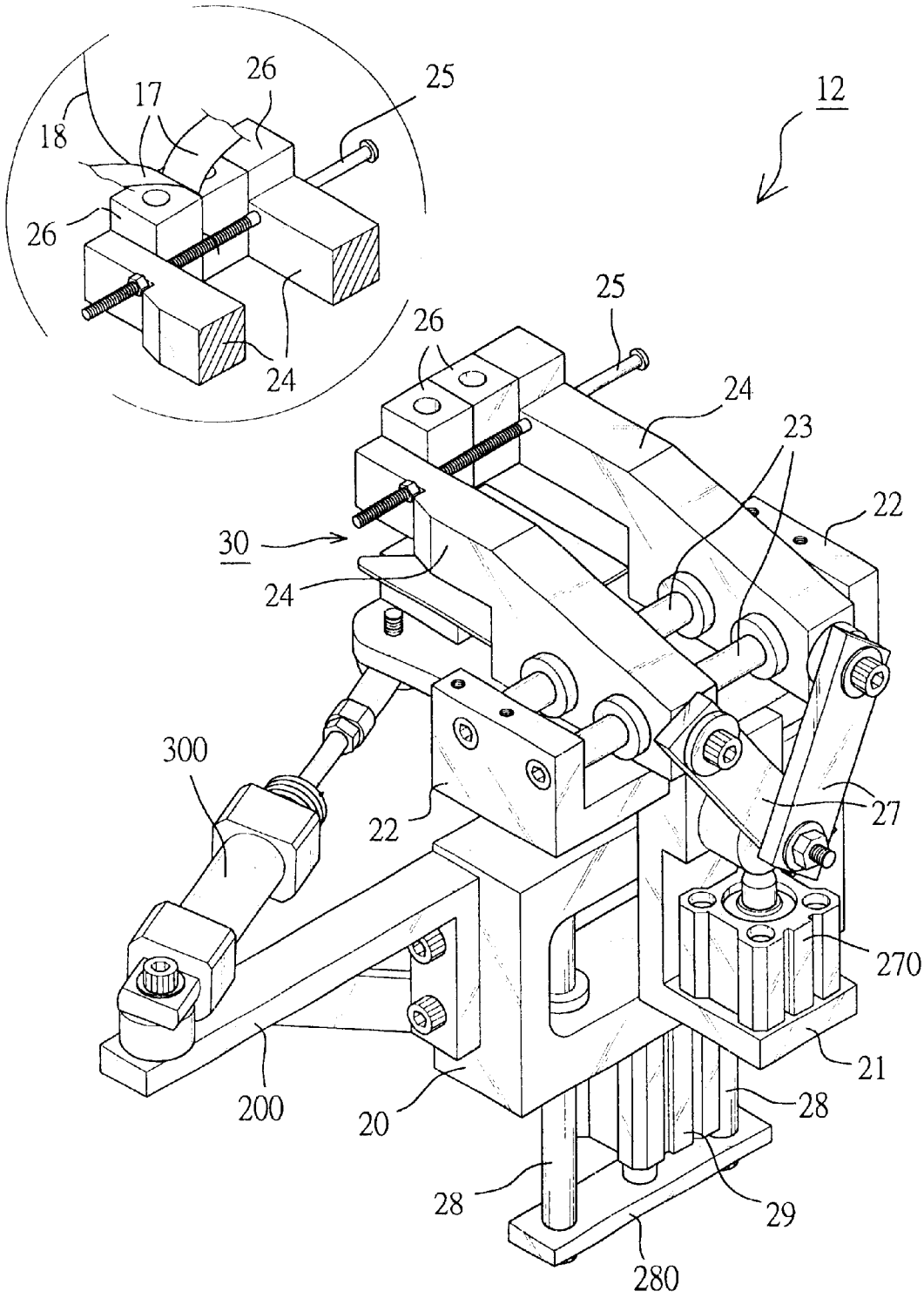
FIG. 14 is a perspective view of the tag cutting device (gripping arms being closed) in accordance with the present invention.
Figure 15:
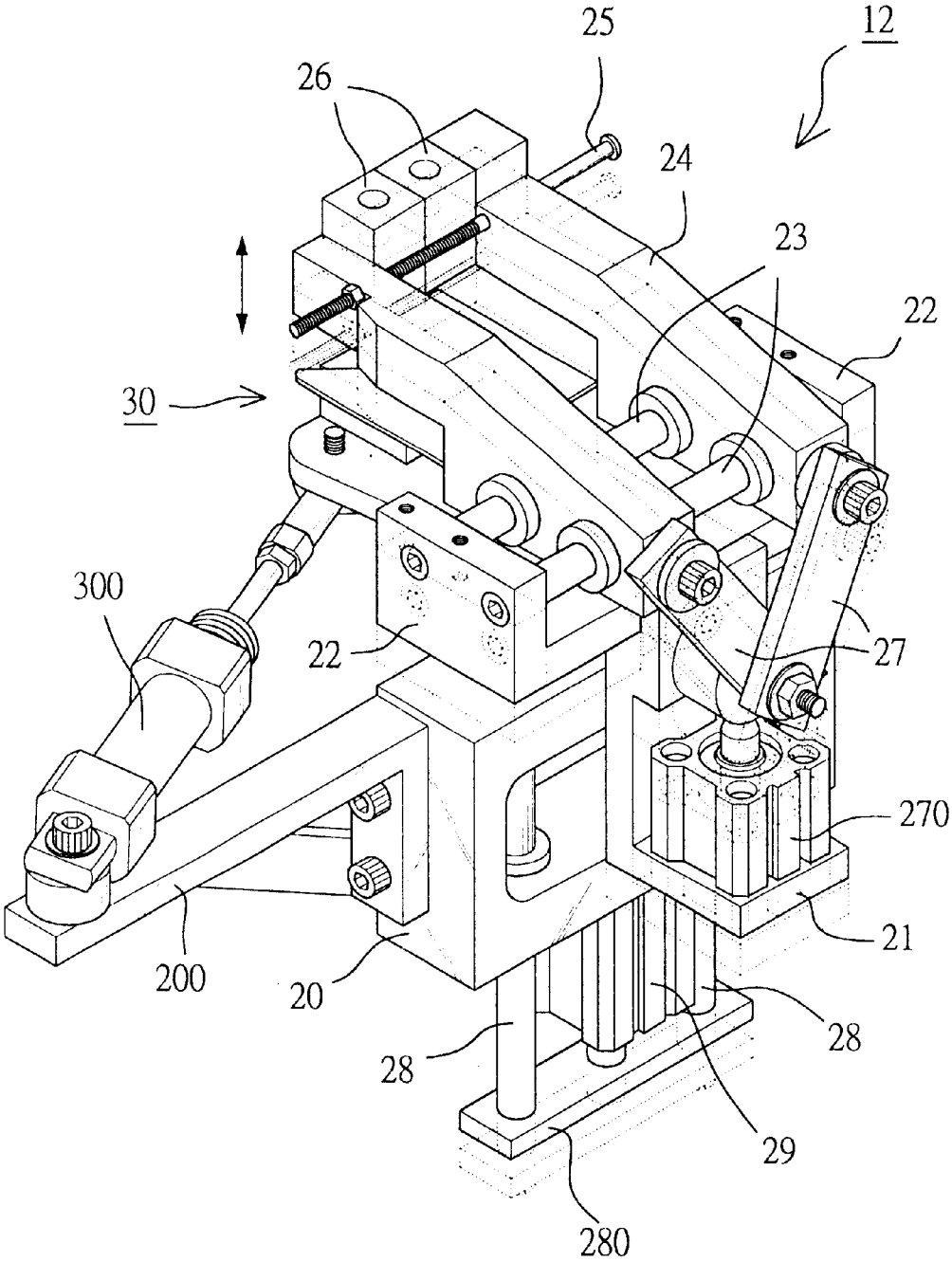
FIG. 15 is a perspective view of the tag cutting device (gripping arms being pulled downward) in accordance with the present invention.

Referring to FIGS. 13 to 15, the tag device 11 comprises a long fixing seat 20, the top end is mounted with a U-shaped seat 22 passed through the fixing seat 20 by two guiding rods 28. The guiding rod 28 passed through the bottom end of the fixing seat 20 is fixed onto the fixing seat 20, and the piston of the cylinder 29 is connected to the bottom plate 280.

The U-shaped seat 22 has two parallel guiding rods 23 and the top of the rod 23 has a pair of gripping arms 24. The inner side of the front end of the gripping arms 24 is provided with a gripping block 26 having a heating device. A limiting rod 26 passes through the gripping arm 24 at the rear side of the gripping block 26. The rear end of the gripping arm 24 is pivotally mounted with a connection rod 27, and the bottom ends of the two connection alms 27 are pivotally onto the piston of the pneumatic cylinder 270. The pneumatic cylinder 270 is fixed at one top end mounted at the L-shaped seat body 21 of the U-shaped seat 22.

Figure 16:
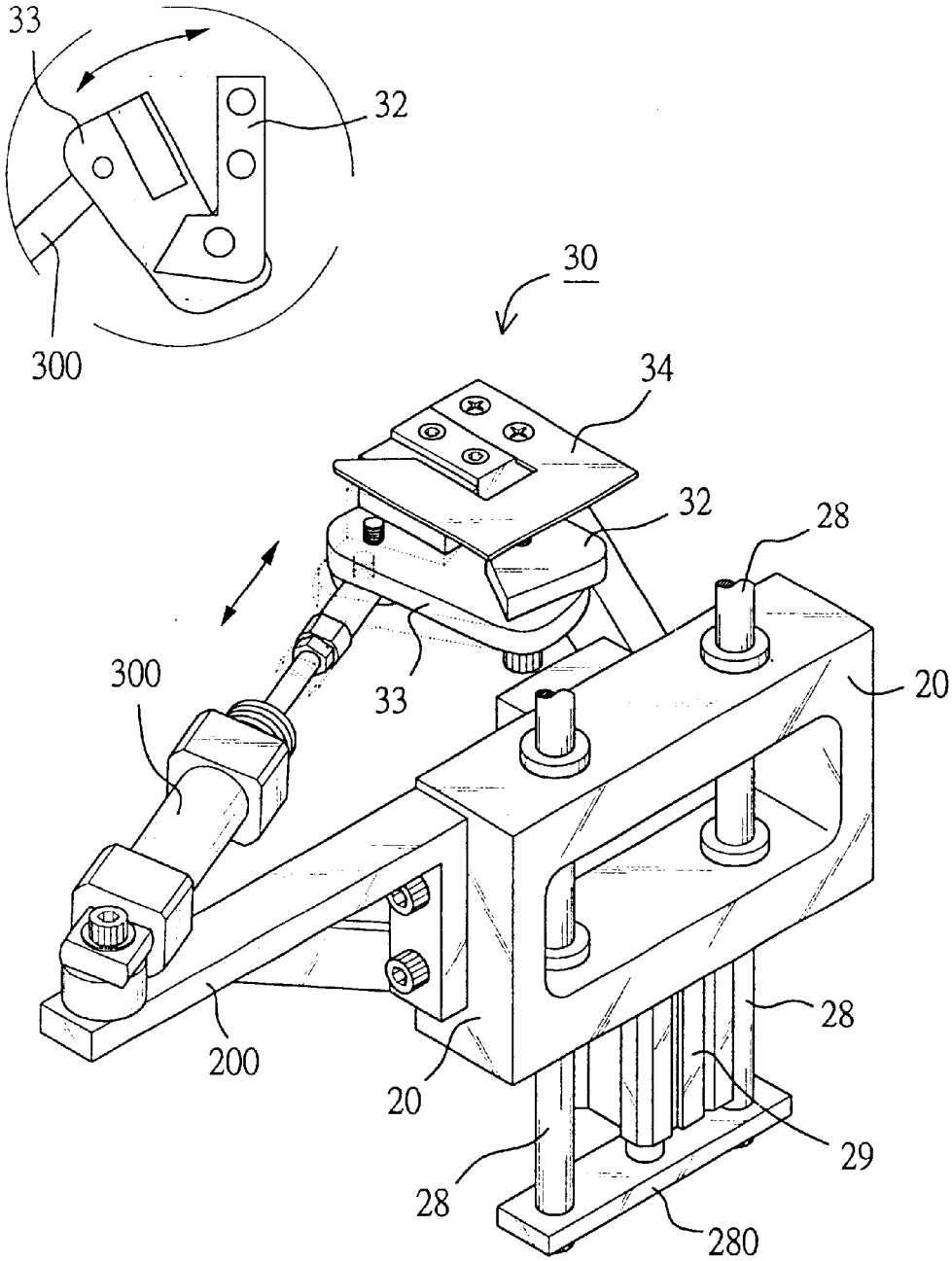
FIG. 16 is a perspective view of the tag cutting device (blade) of the present invention.
Figure 17:
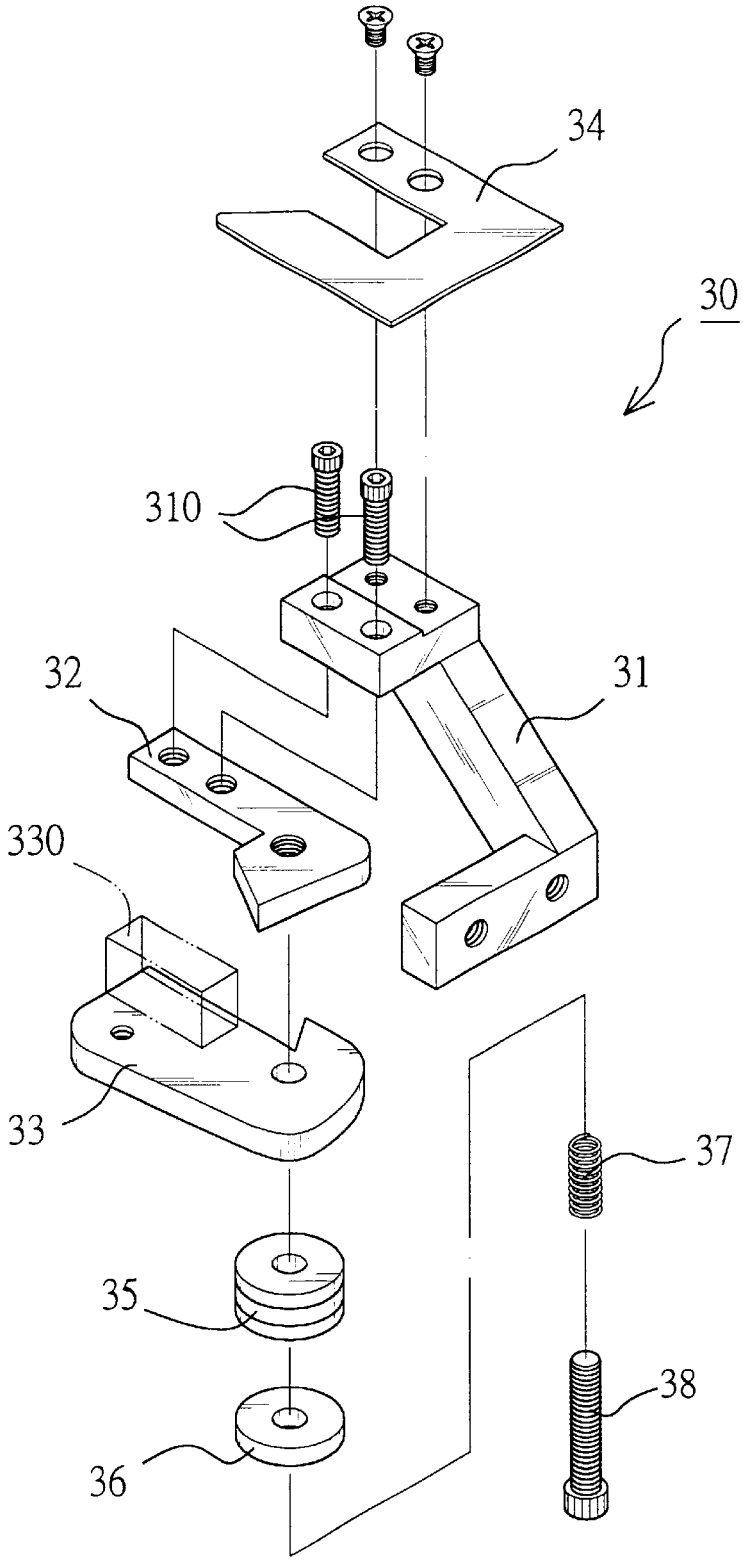
FIG. 17 is an exploded perspective view of the tag cutting device of the present invention.

Referring to FIGS. 16 and 17, the other side of the U-shaped seat 22 is mounted with a cutter device 30 having a fixing arm 31 mounted with a fixing blade 32 by nut 310. The bottom end of the blade 32 is pivotally mounted with a moving blade 33 by means of screw nuts 38 together with a spring 37, pad 36 and a bearing. The inner side of the moving blade 33 is provided with a blocking block 330, corresponding to the inner side of the moving blade 33 and the fixing arm 31, and the top end is covered with the U-shaped top plate. After that, the side of the fixing seat 20 is pivotally mounted to a pneumatic cylinder 300 by a support 200 and a piston is pivotally mounted to the moving blade 33.

In accordance with the present invention, the two corresponding tag 17 are respectively inserted into the gap between the gripping block 26, and after the cotton thread 18 is cut, one end of the thread is provided to the top end of the tea bag by the threading device for sealing, and the other end of the thread is vertically sunk between the two gripping block 26 and is supported by the limiting rod 25. When the piston rod of the pneumatic cylinder 270 is pulled downward, the driving interconnected rod 27 gripes the gripping arm 24 along the guiding rod 23, such that the two gripping blocks 26 are gripped and the cotton thread 18 and the tag 17 are sealed (as shown in FIG. 2).

The bottom board 280 drives the two guiding rods 28 downward and in turn, the entire U-shaped seat 22 is driven downward. The tag is driven a distance by the gripping block 26, and then the pneumatic cylinder 300 drive the moving blade 33 and the fixing blade 32 to cut and the sealed tag 17 is cut to form a single unit. The un-cut tag 17 is gripped by the blocking block 330 and the piston rod of the pneumatic cylinder 270 moves up and the interconnected rod 27 drives the gripping arm 24 to form an opening. The piston rod of other pneumatic cylinder 29 is retracted to drive the bottom plate 280, in turn driving the guiding rod 28 to drive the U-shaped block 28 to move upward for next repeated cycle.

When the gripping block 26 is proceeded for a second gripping action, the piston rod will drive the moving blade 33 to form an opening situation so that the tag 17 is provided for a cutting. Thus, the filing device of the present invention provides the filling tea bag with fixed amount of tea leaves and seals the tea bag.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiment, but only by the scope of the appended claims.

I claim:

1. A filling device of a dual-layered filling and packing device having a cotton paper device within the packing device which guides cotton paper via a guide rack to fold the paper and to fill a paper bag with fixed amount of tea leaves, by means of a roller, the paper bag with tea leaves being sealed at the edges thereof, and by means of a gripping structure, the tea bag being held to a funnel tube of the folding structure, a plurality of rollers delivered packing foil from an insertion section through space between a folding slot and the funnel tube, characterized in that a) the gripping structure comprises a magnetic cylinder interconnected to a Y-shaped pneumatic cylinder and the gripping section is extended with two corresponding folding board;

(b) the folding structure comprises a folding slot covered a gap outside the funnel tube, the cross-section of the funnel tube has a flat body and the folding slot is a U-shaped plate body having a top end folded outward to form the insertion section.

2. A filling device of a dual-layered filling and packing device having a cotton paper device within the packing device which guides cotton paper via a guide rack to fold the paper and to fill a paper bag with fixed amount of tea leaves, by means of a roller, the paper bag with tea leaves being sealed at the edges thereof, and by means of a gripping structure, the tea bag being held to a funnel tube of the folding structure, a plurality of rollers delivered packing foil from an insertion section through space between a folding slot and the funnel tube, characterized in that the guiding slot is two-plate bodies folded and is provided with an opening at a rear end thereof, and a front end of the guiding slot is a folded structure having a notch with a blocking section; and the gripping structure has a pneumatic cylinder driving a swinging arm to rotate and a center of rotating of the arm is located on a gear, and on the swinging arm, stepped gear, gripping gear are pivotally mounted such that the small gear of the stepped gear is in engagement with the gear and the big gear is in engagement with the gripping gear, and the stepped gear is pivotally connected with the pneumatic cylinder and the gripping gear is extended out with two connection plates from the swinging arm for the mounting of Y-shaped pneumatic cylinder and the gripping section of the Y-shaped pneumatic cylinder extended outward by means of the folding boards, wherein the two connection plates are fastened with screws, allowing the adjustment of distance and angle of the connection plates for various sizes of tea bags, and the top end of the funnel tube has a sloping board upward for blocking the guiding of tags.

3. A filling device of a dual-layered filling and packing device having a cotton paper device within the packing device which guides cotton paper via a guide rack to fold the paper and to fill a paper bag with fixed amount of tea leaves, by means of a roller, the paper bag with tea leaves being sealed at the edges thereof, and by means of a gripping structure, the tea bag being held to a funnel tube of the folding structure, a plurality of rollers delivered packing foil from an insertion section through space between a folding slot and the funnel tube, characterized in that a tag cutting device comprises: a fixing seat having a long fixing seat, the top end is mounted with a U-shaped seat passed through the fixing seat by two guiding rods the guiding rod passed through a bottom end of the fixing seat is fixed onto the fixing seat, and the piston of the cylinder is connected to the bottom plate and the U-shaped seat has two parallel guiding rods and the top of the rod has a pair of gripping arms an inner side of a front end of the gripping arms is provided with a gripping block having a heating device a limiting rod passes through the gripping arm at a rear side of the gripping block the rear end of the gripping arm is pivotally mounted with a connection rod, and bottom ends of the two connection arms are pivotally onto the piston of the pneumatic cylinder the pneumatic cylinder is fixed at one top end mounted at the L-shaped scat body of the U-shaped seat, wherein the gripping arm is passed through by a limiting rod, allowing the positioning of the ends of the cotton thread, and a cutter device having a fixing arm mounted with a fixing blade by nut, the bottom end of the blade is pivotally mounted with a moving blade by means of screw nuts together with a spring, pad and a bearing, the inner side of the moving blade is provided with a blocking block, corresponding to the inner side of the moving blade and the fixing arm, and the top end is covered with the U-shaped top plate.

* * * * *